US006749404B2

(12) United States Patent
Gennami et al.

(10) Patent No.: US 6,749,404 B2
(45) Date of Patent: Jun. 15, 2004

(54) SCROLL COMPRESSORS

(75) Inventors: Hiroyuki Gennami, Kariya (JP); Kazuhiro Kuroki, Kariya (JP); Ken Suitou, Kariya (JP); Kazuya Kimura, Kariya (JP); Shinji Tsubai, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 17 days.

(21) Appl. No.: 10/183,184

(22) Filed: Jun. 25, 2002

(65) Prior Publication Data

US 2003/0017058 A1 Jan. 23, 2003

(30) Foreign Application Priority Data

Jun. 28, 2001 (JP) ..... 2001-196969

(51) Int. Cl.[7] ..... F04B 49/00
(52) U.S. Cl. ..... 417/212; 418/1; 418/180
(58) Field of Search ..... 417/212, 213, 417/410.5, 292, 310; 418/1, 55.1, 180, 151

(56) References Cited

U.S. PATENT DOCUMENTS

| | | | | |
|---|---|---|---|---|
| 4,216,661 A | * | 8/1980 | Tojo et al. | 62/505 |
| 4,343,599 A | * | 8/1982 | Kousokabe | 418/55 |
| 4,365,941 A | * | 12/1982 | Tojo et al. | 417/372 |
| 4,473,343 A | * | 9/1984 | Hazaki et al. | 418/55 |
| 4,522,575 A | | 6/1985 | Tischer et al. | 418/55 |
| 4,611,975 A | * | 9/1986 | Blain | 418/5 |
| 2002/0136653 A1 | | 9/2002 | Gennami et al. | 418/55.6 |

FOREIGN PATENT DOCUMENTS

| | | |
|---|---|---|
| EP | 0 338 835 | 10/1989 |
| JP | 58-117380 | 7/1983 |
| JP | 61 118580 | 6/1986 |
| JP | 62 199986 | 9/1987 |
| JP | 1-155088 | * 6/1989 |
| JP | 01 253581 | 10/1989 |
| JP | 2-149783 | * 6/1990 |
| JP | 05 187370 | 7/1993 |
| JP | 2000 088376 | 3/2000 |

OTHER PUBLICATIONS

EP 02 01 3989 Search Report dated Dec. 10, 2002.
U.S. patent application Ser. No. 10/105,606, Gennami et al., filed Mar. 25, 2002.
U.S. patent application Ser. No. 10/105,538, Gennami et al., filed Mar. 25, 2002.
U.S. patent application Ser. No. 10/105,540, Gennami et al., filed Mar. 25, 2002.

* cited by examiner

*Primary Examiner*—Justine R. Yu
*Assistant Examiner*—Han L Liu
(74) *Attorney, Agent, or Firm*—Woodcock Washburn LLP

(57) ABSTRACT

Scroll compressors (100, 110) may include a movable scroll (20) that is disposed opposite to a fixed scroll (2). At least one compression chamber (32) is defined between the fixed scroll and the movable scroll. A motor (49) drives the movable scroll, so that the movable scroll revolves (orbits) relative to the fixed scroll. The movable scroll includes a front portion (20*b*) that slidably contacts the fixed scroll. The front portion receives the pressure of the pressurized refrigerant that is disposed within the compression chamber. The movable scroll also includes a rear portion (20*a*) that slidably contacts a portion (4*a*) of a compressor housing. The motor is disposed within a motor chamber (45) defined within the compressor housing. A first conduct route (94) communicates discharged refrigerant from a discharge-side region (85) to the motor chamber. A second conduct route (97, CL) communicates refrigerant from the motor chamber to a suction-side region (98), thereby adjusting the pressure within the motor chamber, so that the opposing pressing forces applied against both sides to the movable scroll can be appropriately adjusted in order to improve compressor efficiency.

17 Claims, 3 Drawing Sheets

SCROLL COMPRESSORS

BACKGROUND OF THE INVENTION

1. Technical Field

The present invention relates to scroll compressors, and in particular to scroll compressors that have a compression mechanism for compressing a refrigerant and also have an electric motor that serves as a drive source for the compression mechanism. Such scroll compressors may be used as rotary compressors.

2. Description of the Related Art

Japanese Laid-open Patent Publication No. 5-312156 discloses a scroll compressor that may be used as a rotary compressor for air conditioning systems or refrigerators. The known scroll compressor includes a movable scroll that rotates relative to a fixed scroll. As the movable scroll rotates, refrigerant is drawn into and compressed within compression chambers defined between the fixed scroll and the movable scroll, so that the refrigerant is highly pressurized. The compressed refrigerant is then discharged from the compression chambers via a discharge port formed in the fixed scroll.

However, when the refrigerant is being compressed, the pressure of the refrigerant that has been highly compressed within the compression chambers may be applied to both the fixed scroll and the movable scroll. Therefore, the movable scroll may be urged in a direction away from the compression chambers (i.e., away from the fixed scroll) by the highly pressurized refrigerant. Because such force is applied to the movable scroll while the movable scroll is rotating relative to the fixed scroll, a resistance force may be generated against the relative sliding movement between sliding contact portions of the movable scroll and a part of a housing that is disposed on the rear side of the movable scroll. If such a resistance force is relatively large, the compression efficiency of the scroll compressor may be reduced.

SUMMARY OF THE INVENTION

Therefore, it is one object of the present teachings to provide improved scroll compressors. For example, in one aspect of the present teachings, scroll compressors are taught that include means for appropriately adjusting or regulating the opposing pressing forces that are applied to the movable scroll, so that resistance against sliding movement can be reduced and compressor efficiency can be increased.

In one of the aspect of the present teachings, scroll compressors are taught that control opposing forces (pressures) that are applied against a movable scroll. By controlling or regulating the opposing forces, resistance to the sliding movement of the movable scroll relative to a fixed scroll and a portion of a compressor housing, which fixed scroll and compressor housing are disposed on opposite sides of the movable scroll, can be appropriately adjusted or regulated.

According to another aspect of the present teachings, scroll compressors may include a movable scroll that is disposed opposite to a fixed scroll. At least one compression chamber may be defined between the fixed scroll and the movable scroll. A motor may drive the movable scroll, so that the movable scroll revolves (orbits) relative to the fixed scroll. As the movable scroll revolves, a refrigerant may be drawn from a suction-side region defined within the compressor into the compression chamber and may be pressurized within the compression chamber. The pressurized refrigerant may then be discharged to a discharge-side region defined within the compressor.

The movable scroll may include a front portion that slidably contacts the fixed scroll. The movable scroll may also include a rear portion that slidably contacts a portion of compressor housing. The pressure of the pressurized refrigerant within the compression chamber may be applied against the front portion of the movable scroll.

The motor is preferably disposed or accommodated within a motor chamber defined within the compressor housing. A first conduct route may serve to communicate discharged refrigerant from the discharge-side region to the motor chamber. The rear surface of the movable scroll may receive pressure that is substantially equal to the pressure within the motor chamber. As a result, the movable scroll may receive pressing forces from both front and rear sides due to the respective pressures within the compression chamber and the motor chamber.

A second conduct route or a controller may serve to adjust or regulate the pressure within the motor chamber, so that the opposing pressing forces applied to the movable scroll may be appropriately adjusted or set. Therefore, the movable scroll may revolve relative to the fixed scroll or the portion of the compressor housing with a minimal or optimal slide resistance.

According to another aspect of the present teachings, the relationship among the pressure (Pm) within the motor chamber (or the pressure of the refrigerant within the motor chamber), the pressure (Ps) within the suction-side region (or the pressure of the suctioned refrigerant), and the pressure (Pd) within the discharge-side region (or the pressure of the discharged refrigerant) may be set as follows: $Ps<Pm<Pd$.

According to another aspect of the present teachings, the controller may include a throttle channel that is defined between the suction-side region and the motor chamber. In this case, the pressure within the motor chamber may be adjusted by permitting refrigerant to flow from the motor chamber into the suction-side region of the compressor. Therefore, the opposing forces applied to the movable scroll may be appropriately balanced. Preferably, the cross sectional area of the throttle channel may be smaller than the cross sectional area of the first conduct route.

According to another aspect of the present teachings, the controller may include a clearance that is defined between the rear surface of the movable scroll and the portion of the compressor housing that faces the rear surface of the movable scroll. In this case, compressed refrigerant within the motor chamber may flow into the suction-side region via the clearance in order to increase the pressure within the suction-side region.

According to another aspect of the present teachings, the controller may include a control valve and the control valve may be disposed within the throttle channel or the second conduct route. In the alternative, the control valve may be disposed within another channel or path that permits the motor chamber to communicate with the suction-side region. In addition, the throttle channel, the clearance and the control valve may be selectively combined to configure the controller.

According to another aspect of the present teachings, methods are taught for balancing opposing forces applied to a movable scroll of a scroll compressor. For example, a first force may be applied against the movable scroll due to the pressure within the motor chamber. The direction of the first force may be opposite to a second force that is applied to the movable scroll due the pressure within the compression chamber. Further, the first force (e.g., the amount of pressure within the motor chamber) may be adjusted or regulated such that the movable scroll revolves with a minimal or optimal resistance between the movable scroll and the fixed scroll and/or the portion of the compressor housing opposite to the movable scroll.

According to another aspect of the present teachings, the step of applying the first force may include communicating discharged refrigerant (compressed refrigerant) from the discharge-side region of the compressor to the motor chamber. According to another aspect of the present teachings, the step of adjusting the first force may include reducing the pressure within the motor chamber. Optionally, the pressure within the motor chamber may be reduced by decreasing the amount of discharged (compressed) refrigerant that is communicated from the discharge side region to the motor chamber. In another optional embodiment of the present teachings, the pressure within the motor chamber may be reduced by relieving the pressure within the compression chamber. In another optional embodiment of the present teachings, the pressure within the motor chamber may be reduced by using a control valve to regulate or control the pressure within the motor chamber.

Additional objects, features and advantages of the present invention will be readily understood after reading the following detailed description together with the accompanying drawings and the claims.

DETAILED DESCRIPTION OF THE INVENTION

Figure 1:
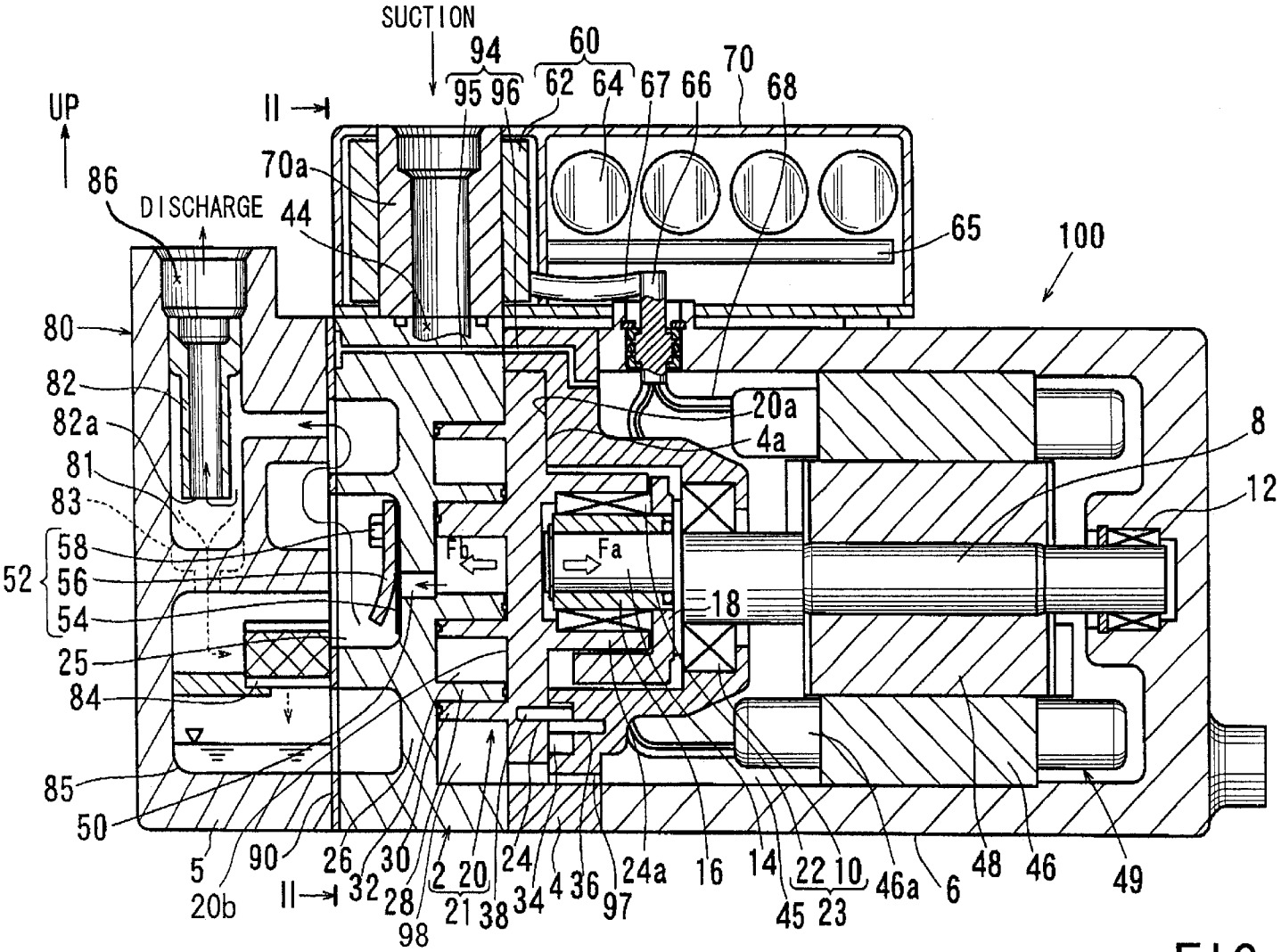
FIG. 1 is a vertical, cross-sectional view of a first representative scroll compressor.

In one embodiment of the present teachings, electrically driven compressors may include a movable scroll that is rotatably disposed opposite to a fixed scroll. A compression chamber may be defined between the movable scroll and the fixed scroll. As the movable scroll rotates, a refrigerant may be drawn into the compression chamber and may be compressed to a high pressurize. The fixed scroll may include a discharge portion (e.g., a discharge valve) and the pressurized refrigerant may be discharged via the discharge portion. The movable scroll may be driven by an electric motor disposed within a motor chamber, so that the movable scroll revolves (orbits) relative to the fixed scroll. Further, the motor chamber may communicate with a rear surface of the movable scroll.

For example, the rear surface of the movable scroll may oppose or face the motor chamber. In another example, a seal member or other intervening member may be disposed between the rear surface of the movable scroll and the motor chamber. In the alternative, the rear surface of the movable scroll may communicate with the motor chamber via a communication channel. Therefore, the pressure that is applied to the rear surface of the movable scroll may be nearly equal to the pressure within the motor chamber.

A first conduct route may permit the motor chamber to communicate with a discharge-side region of the compressor. For example, the compressed refrigerant that has been discharged from the discharge portion of the fixed scroll may be directed into the discharge-side region. According to this embodiment, the compressed refrigerant disposed within the discharge-side region may be directed from the discharge-side region to the motor chamber due to a difference in pressure between the discharge-side region and the motor chamber.

In another embodiment of the present teachings, a second conduct route may control or regulate the flow of refrigerant between the motor chamber and a suction-side region of the compressor. In this case, the second conduct route may control or restrict the flow of refrigerant (that has been supplied into the motor chamber via the first conduct route) into the suction-side region.

In one optional embodiment of the present teachings, the second conduct route may define a throttle channel that connects the motor chamber to the suction-side region. In this case, the throttle channel may throttle (regulate) the flow of refrigerant into the suction-side region. In another optional embodiment of the present teachings, the second conduct route may include a clearance defined between the motor chamber and the suction-side region. In this case, the clearance may restrict or regulate the flow of refrigerant into the suction-side region. In addition or in the alternative, the second conduct route may include a control valve that is disposed in a communication path between the motor chamber and the suction-side region. In this case, the control valve may control or regulate the flow of refrigerant from the motor chamber into the suction-side region.

In another optional embodiment of the present teachings, the throttle channel, the clearance and the control valve may be selectively combined to regulate (restrain or control) the flow of refrigerant from the motor chamber to the suction-side region of the compressor.

In the present specification, the term "suction-side region" preferably includes a portion of the compressor that is proximal to the refrigerant intake side of the compression chamber and/or a portion of the compression chamber that performs a predetermined part of the compression process.

According to the present teachings, the pressure within motor chamber may be set to a predetermined intermediate pressure, which pressure is between the pressure of the discharged refrigerant and the pressure within the suction-side region. The intermediate pressure refrigerant will generate a force that may be applied against the rear surface of the movable scroll so as to urge the movable scroll toward the fixed scroll. In the present specification, the term "a predetermined intermediate pressure" may be a fixed pressure or may be a variable pressure within a predetermined range.

The pressure within the compression chamber may be applied to the front surface or front side of the movable scroll. Moreover, the pressure within the motor chamber may be applied to the rear surface or rear side of the movable scroll. By adjusting or regulating the pressure within the motor chamber to an intermediate pressure (or within a predetermined range of intermediate pressures), the balance of the opposing pressures applied against the movable scroll can be appropriately adjusted. For example, by setting the pressures such that the movable scroll will shift toward the front side of the compressor, reductions in compressor efficiency can be prevented. Thus, the second conduct route may control or regulate the flow of refrigerant between the motor chamber and the suction-side region in order to appropriate adjust the opposing pressures applied to the movable scroll.

The second conduct route may be configured as a throttle channel defined between the motor chamber and the suction-side region. For example, the cross sectional area of the throttle channel preferably may be smaller than the cross sectional area of the first conduct route, so that the flow of refrigerant toward the suction-side region may be regulated (throttled). According to this arrangement, the pressure within the motor chamber may be set to an intermediate pressure between the pressure of the discharged refrigerant and the pressure within the suction-side region. The intermediate pressure may be applied to the rear surface of the movable scroll so as to press or urge the movable scroll against the fixed scroll. Therefore, the forces applied to the movable scroll can be easily adjusted using a simple throttle channel.

If the second conduct route is configured as a clearance between the motor chamber and the suction-side region, the conduct route may naturally be defined during the assembly of the compressor. For example, such a clearance may be defined between sliding contact portions of the movable scroll and a portion of the compressor housing that faces the rear side of the movable scroll. Therefore, the flow of refrigerant from the motor chamber to the suction-side region may be controlled or restricted by the clearance, so that the pressure within the motor chamber may become the intermediate pressure between the pressure of the discharged refrigerant and the pressure within the suction-side region.

If the clearance is very small, the pressure within the motor chamber will increase when the compressor is started. Therefore, due to the unbalance between the opposing forces applied against the movable scroll by the pressure within the motor chamber and the pressure within the compression chamber, the movable scroll may shift toward the front side of the compressor, thereby increasing the clearance along the sliding contact portions. Then, further increases in the pressure within the motor chamber may be restricted and the amount of refrigerant that flows from the motor chamber into the suction-side region may be increased, so that the pressure within the motor chamber will decrease.

As a result, the movable scroll may shift toward the rear side of the compressor, thereby reducing the width or cross-section of the clearance. Consequently, the movable scroll may alternately shift toward the front side and the rear side so as to vary the size of the clearance and to regulate the pressure within the motor chamber to a predetermined value or within a predetermined range. Thus, the opposing forces applied to the movable scroll can be appropriately balanced utilizing a clearance that may be easily defined within the compressor.

In another embodiment of the present teachings, the second conduct route may regulate (control or restrain) the flow of refrigerant into the motor chamber. For example, the second conduct route itself may have a small cross-sectional area. In the alternative, a separate throttle member may be disposed within the second conduct route. According this alternative arrangement, the amount of refrigerant that flows into the motor chamber may be prevented from excessively increasing, so that reductions in compressor efficiency can be minimized.

In another embodiment of the present teachings, methods are taught that may include communicating or directing discharged refrigerant into the motor chamber. The flow of refrigerant from the motor chamber into the suction-side also may be regulated, so that the pressure within the motor chamber is set to an intermediate pressure between the pressure of the discharged refrigerant and the pressure within the suction-side region. The intermediate pressure will generate a force that may be applied to the rear surface of the movable scroll in order to press or urge the movable scroll against the fixed scroll. The movable scroll also may receive a force that is produced by the pressure within the compression chamber and that is applied to the front surface of the movable scroll. The pressure within the motor chamber may be set to the intermediate pressure, so that the opposing forces applied to the movable scroll may be appropriately balanced. For example, the movable scroll may be shifted toward the front side such that the sliding contact portions of the movable scroll and a compressor housing on the rear side of the movable scroll move away from each other in order to decrease the resistance against sliding movement. As a result, reductions in compressor efficiency may be minimized. Thus, the opposing forces applied to the movable scroll may be appropriately adjusted by controlling or restraining the flow of refrigerant from the motor chamber to the suction-side region.

In another embodiment of the present teachings, methods may include using a throttle channel in order to adjust or regulate the pressure within the motor chamber to the intermediate pressure, which intermediate pressure is between the discharged refrigerant and the suction-side region. The intermediate pressure will produce a force that may be applied to the rear surface of the movable scroll, thereby urging or pressing the movable scroll against the fixed scroll. Therefore, the opposing forces applied to the movable scroll can be easily adjusted or regulated by using a simple throttle channel.

In another embodiment of the present teachings, methods may include communicating compressed refrigerant via a clearance in order to set the pressure within the motor chamber to the intermediate pressure between the discharged refrigerant and the suction-side region. In this embodiment as well, the opposing forces applied to the movable scroll also can be easily adjusted or regulated by using a simple clearance.

Each of the additional features and teachings disclosed above and below may be utilized separately or in conjunction with other features and teachings to provide improved scroll compressors and methods for designing and using such scroll compressors. Representative examples of the present invention, which examples utilize many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

Generally speaking, the representative embodiments of the present teachings concern scroll compressors that increase the pressure of drawn or suctioned refrigerant by compressing the refrigerant within a compression chamber that is defined between a fixed scroll and a movable scroll. The refrigerant is then discharged as compressed or pressurized refrigerant.

First Representative Embodiment

A first representative scroll compressor 100 will now be described with reference to FIGS. 1 and 2, which respectively show a vertical sectional view of the scroll compressor 100 and a cross-sectional view along the line II—II in FIG. 1. The arrow "UP" in FIGS. 1 and 2 indicates the upward (vertical) direction for the scroll compressor 100.

Generally speaking, the compressor 100 may include a fixed scroll 2, a center housing 4, a front housing 5, and a motor housing 6. These structures may generally define a compressor housing. As shown in FIG. 1, the left-side end face of the center housing 4 may be coupled to the right-side end face of the fixed scroll 2. The motor housing 6 may be coupled to the right-side end face of the center housing 4. The front housing 5 may be coupled to the left-side end face of the fixed scroll 2. A drive shaft 8 may be rotatably supported by the center housing 4 and the motor housing 6 via radial bearings 10 and 12. An eccentric (or offset) shaft 14, which is eccentric or offset relative to the drive shaft 8, may be integrally formed on the end of the drive shaft 8 on the side of the center housing 4 (the left side as viewed in FIG. 1).

A bushing 16 may be fitted onto the eccentric shaft 14 so as to rotate together with the eccentric shaft 14. A balancing weight 18 may be disposed on the right-side end of the bushing 16 as viewed in FIG. 1, so as to rotate together with the bushing 16. A movable scroll 20 may be supported on the left-side periphery of the bushing 16 via a needle bearing 22 so as to oppose (face) the fixed scroll 2 and rotate or orbit relative to the fixed scroll 2. The fixed scroll 2 and the movable scroll 20 may basically define a compression mechanism 21 for compressing a refrigerant. The needle bearing 22 may be fitted into a cylindrical boss portion 24*a* that protrudes or projects from the right-side surface of a base plate 24 of the movable scroll 20 as viewed in FIG. 1. The needle bearing 22 and the radial bearing 10 may generally define a bearing mechanism 23 of the movable scroll 20.

The fixed scroll member 2 may include a substantially disc-shaped base plate 26. A spiral-shaped, e.g., involute-shaped, fixed scroll wall (lap) 28 may be disposed so as to protrude or project from the right-side surface (as viewed in FIG. 1) of the base plate 26. Likewise, a spiral-shaped (e.g., involute-shaped) movable scroll wall (lap) 30 may be disposed so as to protrude or project from the left-side surface (as viewed in FIG. 1) of the base plate 24 of the movable scroll 20. The movable scroll 20 and the fixed scroll 2 may preferably be positioned such that the scroll wall 28 engages the scroll wall 30.

The base plate 26 and the fixed scroll wall 28 of the fixed scroll 2 together with the base plate 24 and the movable scroll wall 30 of the movable scroll 20 may define a crescent-shaped compression chamber (substantially sealed space) 32. For example, the fixed scroll wall 28 may slidingly contact the movable scroll wall 30 at a plurality of sliding contact areas (or points). The movable scroll 20 may revolve or orbit as the eccentric shaft 14 rotates. During this rotating or orbiting movement, the balancing weight 18 cancels the centrifugal force accompanying the revolution of the movable scroll 20. The eccentric shaft 14 (that rotates together with the drive shaft 8), the bushing 16 and the needle bearing 22, which are disposed between the eccentric shaft 14 and the boss portion 24*a* of the movable scroll 20, may cooperate to transmit the rotational force of the drive shaft 8 to the movable scroll 20 as orbiting movement.

A plurality of (e.g., four) concave areas 34 may be defined on the same circumferential (circular) line at uniform angular intervals on the left-side end face (as viewed in FIG. 1) of the center housing 4. Each of the concave areas 34 may cooperate with a first pin 36 and a second pin 38. The first pin 36 may be secured to the center housing 4 and the second pin 38 may be secured to the base plate 24 of the movable scroll 20. The first pin 36 and the second pin 38 may extend into the corresponding concave area 34. The concave area 34, the first pin 36 and the second pin 38 may cooperate with each other to prevent the movable scroll 20 from self-rotating as the eccentric shaft 14 rotates. In other words, the concave area 34, the first pin 36, and the second pin 38 may constitute a self-rotation prevention mechanism for the movable scroll 20.

Figure 2:
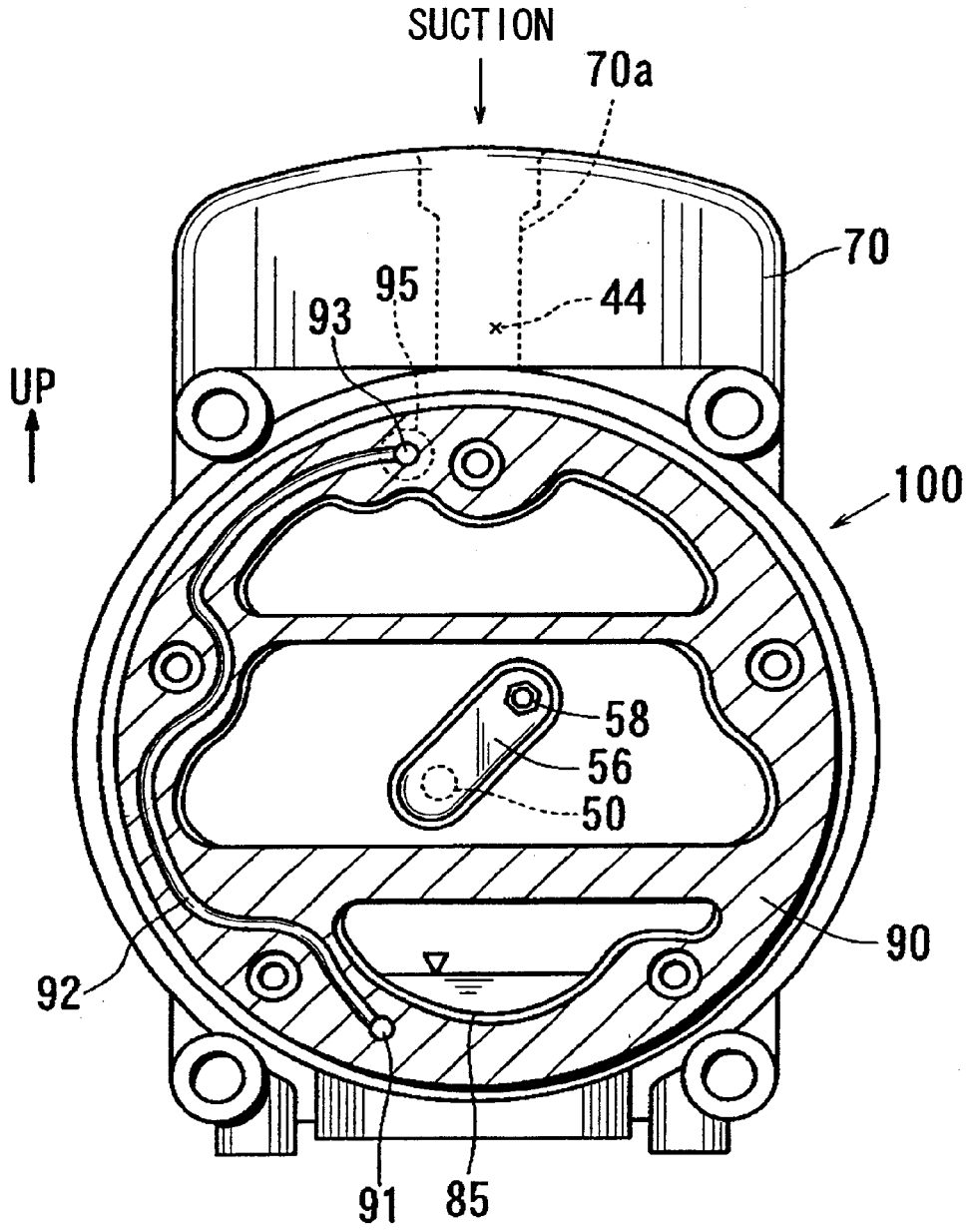
FIG. 2 is a cross-sectional view take along line II—II in FIG. 1.

As shown in FIGS. 1 and 2, the base plate 26 of the fixed scroll 2 may include a reed-type discharge valve 52 that opens and closes a discharge opening 50. The discharge valve 52 may include a reed valve member 54, which has a shape that corresponds to the discharge opening 50, and a valve retainer 56 for holding or retaining the reed valve member 54. The reed valve member 54 and the valve retainer 56 may be secured to the base plate 26 of the fixed scroll 2 by means of a securing bolt 58. The discharge valve 52 may be disposed within a discharge chamber 25 that is defined within the base plate 26 of the fixed scroll 2. Preferably, the reed valve member 54 opens and closes according to differences in pressure between the compression chamber 32, which communicates with the discharge opening 50, and the discharge chamber 25. That is, when the pressure within the compression chamber 32 is higher or greater than the pressure within the discharge chamber 25, the reed valve member 54 will open. Naturally, when the pressure in the compression chamber 32 is lower or less than the pressure in the discharge chamber 25, the reed valve member 54 will be closed. The valve retainer 56 may retain the reed valve member 54 and may be configured to regulate the maximum opening of the reed valve member 54.

As shown in FIG. 1, an electric motor 49 may be disposed within the motor housing 6. An inverter 60 for controlling the operation of the electric motor 49 may be installed on the periphery of the compressor housing, which housing essentially consists of the fixed scroll 2, the center housing 4, and the motor housing 6. The inverter 60 may include, e.g., a switching element 62 that generates a relatively large amount of heat, and capacitors 64 that generate a relatively small amount of heat. The inverter 60 also may include an inverter case 70 for housing (enclosing) capacitors 64 in order to separate the high heat-generating components from the low heat-generating components. The inverter case 70 may preferably contain a cylinder 70*a*, and the switching element 62 may be disposed on the periphery of this cylinder 70*a*. The inverter case 70 also may include a base plate 65 for installing the capacitors 64. One end of the cylinder 70*a* of inverter case 70 may preferably communicate with a suction port 44. The other end of the cylinder 70*a* may preferably communicate with a refrigerant feedback pipe (not shown) of an external circuit.

The switching element 62 within the inverter case 70 may be electrically coupled to the electric motor 49 by means of three conducting pins 66 (only one of which is shown in FIG. 1) and conductive wires 67 and 68. The conducting pins 66 may preferably penetrate into the motor housing 6 and the inverter case 70. Electric current necessary for driving the electric motor 49 may be supplied via these conducting pins 66 and the conductive wires 67 and 68.

The location for connecting the conductive wire 68 with a stator coil 46*a* of the electric motor 49, which will be further described below, may preferably be provided on the side of the electric motor 49 that faces the compressor mechanism 21. The inverter 60 may be secured to the compressor housing (e.g., the center housing 4 and/or the motor housing 6). The location for connecting the electric motor 49 with the inverter 60 may preferably be provided on the periphery of the compressor housing along its diametric direction. This configuration will provide a compact design with a much shorter axial length than a configuration in which the inverter (or a similar device) is disposed on the periphery along the axial direction. Moreover, the location for connecting the electric motor 49 with the inverter 60 may be selected such that these components are relatively close to each other. As a result, because the electric motor 49 can be connected to the inverter 60 over the shortest possible distance, a short connection member can be used. Consequently, material cost and weight can be reduced, and performance can be improved by minimizing voltage drops across the connection member.

A stator 46 may be secured to the inner surface of the motor housing 6 and a rotor 48 may be secured to the drive shaft 8. The drive shaft 8, the stator 46, and the rotor 48 may generally define the electric motor 49. The rotor 48 and drive shaft 8 may rotate together by supplying electric current to the stator coil 46*a* of the stator 46. The electric motor 49 may preferably be disposed within a substantially sealed motor chamber 45, which is defined within the motor housing 6 and center housing 4.

As the eccentric shaft 14 of the drive shaft 8 rotates, the movable scroll 20 revolves (orbits), and the refrigerant drawn or suctions via the suction port 44 (which is defined within the fixed scroll 2) flows into the space between the base plate 26 of the fixed scroll 2 and the base plate 24 of the movable scroll 20 from the edge of both scrolls 2 and 20. As the movable scroll 20 revolves, the second pin 38 slides along the circumferential (peripheral) surface of the first pin 36. Then, when the eccentric shaft 14 further rotates, the movable scroll 20, which is rotatably mounted on the eccentric shaft 14 via the needle bearing 22, revolves around the central axis of the drive shaft 8 without rotating itself. As the movable scroll 20 revolves, the refrigerant that has been suctioned through the suction port 44 flows into the compression chamber 32 and is guided into the central portion of the fixed scroll 2. As a result, the refrigerant pressure will increase. Then, the pressurized (compressed) refrigerant flows through the discharge opening 50 that is defined within the center of the base plate 26 of the fixed scroll 2. That is, the discharge opening 50 communicates with the compression chamber 32 where the pressure reaches its highest value.

Optionally, the front housing 5 may include an oil separator 80 for separating lubricating oil disposed within the refrigerant that has been discharged from the discharge chamber 25. This oil separator 80 may utilize, e.g., a separation mechanism that relies upon centrifugal force to separate the lubricating oil from the refrigerant. Thus, the oil separator 80 may generally include an oil separation chamber 81, a cylindrical member 82, a filter 84 installed below the cylindrical member 82, and a storage area (lubricating oil reservoir) 85 for temporarily storing the separated lubricating oil. A connection hole or passage 83 may be defined between the oil separation chamber 81 and the storage area 85 in order to allow lubricating oil to pass from the oil separation chamber 81 into the storage area 85.

When the compressed refrigerant discharged from the discharge chamber 25 is introduced into the oil separator 80, as indicated by the curved, solid-line arrow in FIG. 1, the compressed refrigerant collides with the cylindrical member 82 disposed within the oil separation chamber 81 and descends while circling (spiraling) around the cylindrical member 82. Therefore, the lubricating oil contained in the compressed refrigerant will separate due to centrifugal force and the lubricating oil will move, due to gravity, as indicated by the dotted-line arrow shown in FIG. 1.

Then, after the lubricating oil passes through the connection hole 83 and the filter 84, the lubricating oil may be temporarily stored in the storage area 85. At the same time, the discharged refrigerant (from which the lubricating oil has been separated) will move from the opening 82*a* of the cylindrical member 82 to a discharge port 86, and then will be transferred to a condenser (not shown) in an external circuit.

A gasket 90 preferably may be disposed between the right end face of the front housing 5 and the left end face of the fixed scroll 2. As shown in FIG. 2, a first oil supply hole 91, which communicates with the storage area 85, may be defined near the bottom of this gasket 90, and a second oil supply hole 93 may be defined near the top of the gasket 90. The first and second oil supply holes 91, 93 may communicate with each other via an oil supply groove (lubricating oil supply passage) 92. A first conduct route 94 may be defined so as to connect to the second oil supply hole 93 and may serve to direct lubricating oil and the discharged refrigerant (within the storage area 85) into the motor chamber 45.

The first conduct route 94 optionally may include a first conduct channel 95 and a second conduct channel 96. The first conduct channel 95 may be defined within the peripheral portion of the base portion 26 of the fixed scroll 2. The second conduct channel 96 may be defined within the peripheral portion of the center housing 4. Thus, the storage area 85, which may define a portion of a discharge-side region, may communicate with the motor chamber 45 via the conduct channel 94. Further, the lubricating oil and the discharged refrigerant disposed within the storage area 85 may be directed (urged) into the motor chamber 45 via the first conduct route 94 due to differences in pressure between the storage area 85 and the motor chamber 45.

A throttle channel 97 may be defined within the center housing 4 in order to permit the motor chamber 45 to communicate with a suction region of the compression mechanism 21. The throttle channel 97 is one example of a second conduct route, as discussed herein. Therefore, the refrigerant that has been communicated into the motor chamber 45 via the first conduct route 94 also may flow via the throttle channel 97 into a suction-side region 98 of the compression mechanism 21. The flow of refrigerant through the first conduct route 94, the motor chamber 45 and the throttle channel 97 may preferably contribute to cooling the electric motor 49.

Optionally, the throttle channel 97 may have a cross-sectional area that is smaller than the cross-sectional area of the first conduct route 94. In this case, during the operation of the scroll compressor 100, refrigerant may first be communicated into the motor chamber 45 and then a portion of that refrigerant may flow via the throttle channel 97 from the motor chamber 45 into the suction-side region 98 of the compression mechanism 21. As a result, the pressure within the motor chamber 45 will gradually increase and may finally be adjusted to a predetermined intermediate pressure Pm, which intermediate pressure Pm is greater than the pressure Ps of the refrigerant suctioned via the suction port 44 and less than the pressure of the discharged refrigerant Pd (e.g., $Ps<Pm<Pd$). At this stage, the pressure applied to a rear surface 20*a* of the movable scroll 20 becomes to be equal to the pressure within the motor chamber 45. The intermediate pressure Pm will produce a force Fb that may be applied to the rear surface 20*a* of the movable scroll 20 in a direction from the rear side (right side as viewed in FIG. 1) toward the front side (left side as viewed in FIG. 1). The force Fb may be calculated by multiplying the intermediate pressure Pm by a pressure-receiving area S of the rear surface 20*a*.

Furthermore, the pressure of the refrigerant within the compression chamber 32 may produce a force Fa that may be applied to a front surface 20*b* of the movable scroll 20. Therefore, the position of the movable scroll 20 relative to the center housing 4 may be determined by the balance between the opposing forces Fa and Fb that are applied to the movable scroll 20. In this specification, the force Fa will also be referred to as a "first force" and the force Fb will also be referred to as a "second force."

For example, when the intermediate pressure Pm is adjusted or regulated to provide the relationship (Fa<Fb), the resistance against relative sliding movement between the rear surface 20*a* of the movable scroll 20 and a front surface 4*a* of the center housing 4 may be reduced, because the movable scroll 20 will move or shift away from the front surface 4*a* of the center housing 4. Such reduction in the resistance may prevent a reduction in the operation efficiency of the compressor and may improve the durability of the compressor. When the pressure within the motor chamber 45 exceeds the predetermined intermediate pressure Pm, such pressure may be adjusted or regulated to the intermediate pressure Pm by enabling refrigerant to flow from the motor chamber 45 to the suction-side region 98 of the compression mechanism 21 through a clearance defined between the rear surface 20*a* and the front surface 4*a*.

On the contrary, when the intermediate pressure Pm is adjusted or regulated to provide the relationship (Fa>Fb), the resistance against the relative sliding movement between the rear surface 20*a* of the movable scroll 20 and the front surface 4*a* of the center housing 4 may increase. However, the resistance against the relative sliding movement between the scroll wall 28 of the fixed scroll 2 and the scroll wall 30 of the movable scroll 20 may be reduced. Therefore, the intermediate pressure Pm may preferably be adjusted or regulated such that the second force Fb becomes substantially equal to the first force Fa.

The configuration (the cross sectional area and the length or other parameters) of the throttle channel 97 may be suitable determined in response to the configuration (the cross sectional area and the length or other parameters) of the first conduct route 94, the desired pressure (set value of the intermediate pressure Pm), the pressure-receiving area S of the rear surface 20*a* and/or any other relevant parameters. In addition, the configurations of the first conduct route 94 and the throttle channel 97 may preferably determined to ensure that (a) the pressure within the motor chamber 45 may quickly increase when the compressor 100 is started, (b) the desired amount of refrigerant is transferred between the discharge-side region (e.g., storage area 85 ), the motor chamber 45 and the suction-side region 98 and (c) the necessary compression efficiency of the compressor is attained.

The lubricating oil that has been directed via the first conduct route 94 to the motor chamber 45 may be partly transferred to the suction-side region 98 via the throttle channel 97. This lubricating oil may be partly transferred to the sliding contact portions of the fixed and movable scrolls 2 and 20 on the outer peripheral side of the scroll wall 30 of the movable scroll 20 via a very small clearance that is defined between the fixed and movable scrolls 2 and 20. The lubricating oil that has been directed to the motor chamber 45 may preferably lubricate the bearing mechanism 23. The lubricating oil that has been supplied to the outer peripheral side of the movable scroll wall 30 may preferably lubricate and/or seal the sliding contact portions of the fixed and movable scrolls 2 and 20. The lubricating oil may subsequently be discharged from the discharge opening 50 together with the refrigerant that has been compressed within the compression chamber 32.

According to the first representative scroll compressor, when the electric motor 49 starts, the refrigerant that returns, e.g., from an evaporator (not shown) of the external circuit may be directed into the compressor 100 via the cylinder 70*a* of the inverter case 70 and the suction port 44. As the refrigerant flows through the cylinder 70*a,* the inverter 60 may be cooled by the suctioned refrigerant. Although the inverter 60 is thus cooled by the suctioned refrigerant in this first representative embodiment, the amount of heat generated by the inverter 60 is much less compared to the amount of heat that is generated by the electric motor 49. Therefore, the rise in the temperature of the suctioned refrigerant caused by cooling the inverter 60 using the suctioned refrigerant is small compared to the temperature rise that would be caused by cooling the electric motor 49 if the entire amount of suctioned refrigerant is supplied into the motor chamber 45. The suctioned refrigerant may then be compressed within the compression chamber 32 as the movable scroll revolves. The compressed refrigerant may be subsequently discharged from the discharge port 86 so as to be fed into a condenser (not shown) of the external circuit.

Therefore, according to the first representative embodiment, the opposing first and second forces that are applied to the movable scroll 20 can be easily adjusted or regulated by using the throttle channel 97, because refrigerant can flow via the throttle channel 97 from the motor chamber 45 to the suction-side region 98 of the compression mechanism 21.

Optionally, a control valve, e.g. an electromagnetic valve (not shown), may be disposed within the throttle channel 97 in order to selectively change or adjust the cross-sectional area of the flow path defined by the throttle channel 97. In this case, the flow of refrigerant may be selectively changed so as to adjust the opposing forces applied to the movable scroll 20 in response to change of design of the compressor 100.

Second Representative Embodiment

A second representative scroll compressor 110 will now be described with reference to FIG. 3, which shows a vertical, cross-sectional view of the entire scroll compressor 110. The basic construction of the second representative scroll compressor 110 is the substantially same as the first representative scroll compressor 100. Therefore, further description will be made only with respect to the constructions that are different from the first representative scroll compressor 100. In addition, the same reference numerals are affixed to the same parts as the first representative scroll compressor 100 and thus, further description of these parts is not necessary.

Figure 3:
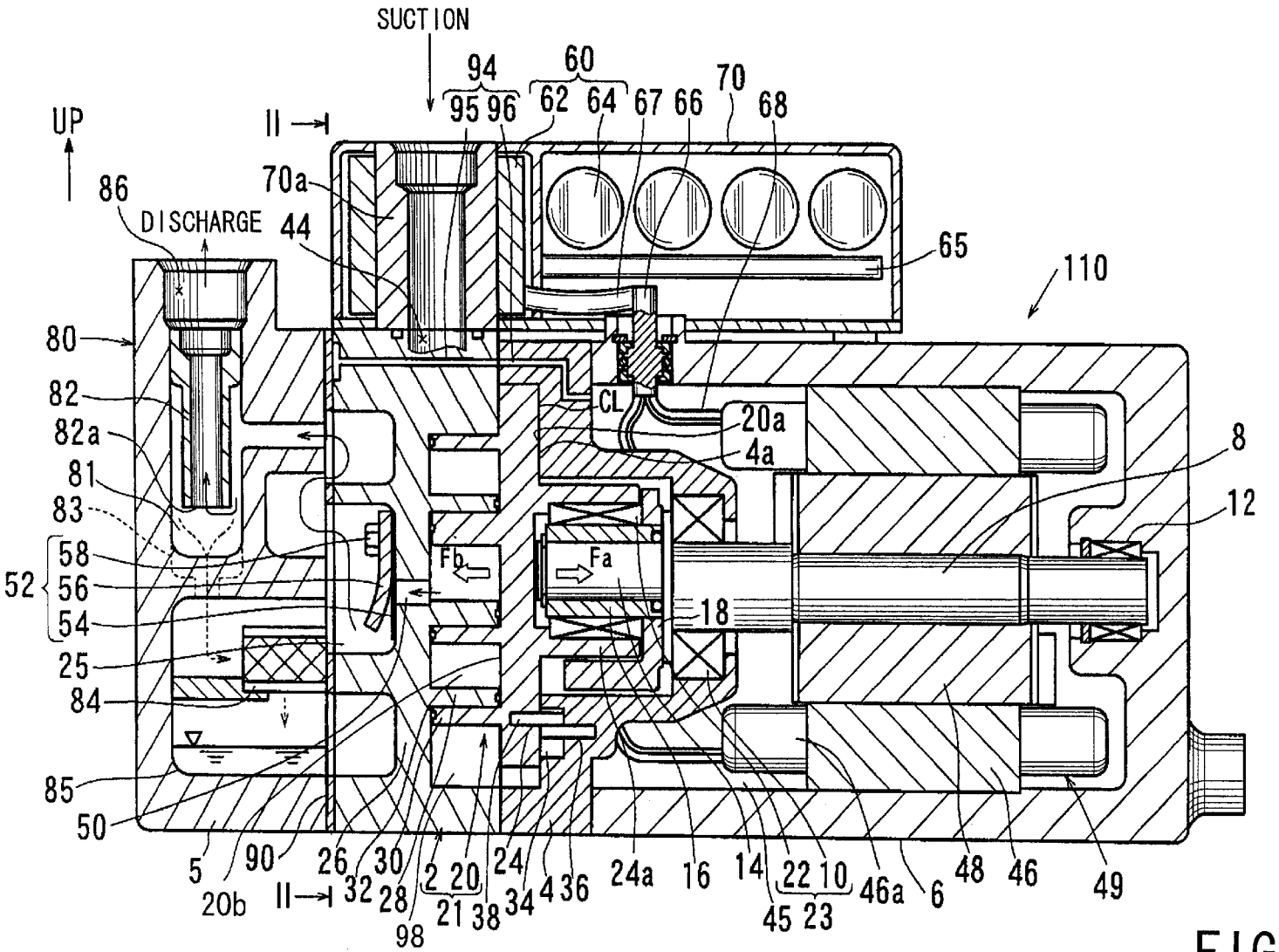
FIG. 3 is a vertical sectional view of a second representative scroll compressor.

Referring to FIG. 3, the second representative scroll compressor 110 does not incorporate the throttle channel 97 within the center housing 4 as in the first representative scroll compressor 100. Instead, the movable scroll 20 may be assembled into the scroll compressor such that a predetermined clearance CL is defined between the rear surface 20*a* of the movable scroll 20 and the front surface 4*a* of the center housing 4. The clearance CL is another example of a second conduct route as discussed in the present specification. Thus, in the second representative embodiment, refrigerant that has been directed into the motor chamber 94 via the first conduct route 94 may flow from the motor chamber 45 to the suction region 98 of the compression mechanism via the clearance CL.

The clearance CL may have a very small size or width and preferably may have a smaller cross section than the cross section of the first conduct route 94. In this case, during the operation of the scroll compressor 110, the refrigerant may be directed into the motor chamber 45. Therefore, the pressure within the motor chamber 45 will gradually increase and may finally be adjusted to a predetermined intermediate pressure Pm between the pressure Ps of the suctioned refrigerant and the pressure Pd of the discharged refrigerant (i.e., Ps<Pm<Pd). At this stage, in the same manner as the first representative scroll compressor 100, the pressure (second force Fb) applied to the rear surface 20*a* of the movable scroll 20 becomes to be equal to the pressure within the motor chamber 45. The intermediate pressure Pm will produce the second force Fb that may be applied to the rear surface 20*a* of the movable scroll 20 in a direction from the rear side (right side as viewed in FIG. 3) toward the front side (left side as viewed in FIG. 3). The second force Fb may be calculated by multiplying the intermediate pressure Pm by the pressure-receiving area S of the rear surface 20*a*.

In the same manner as the first representative scroll compressor 100, the pressure of the refrigerant within the compression chamber 32 may produce the first force Fa that may be applied to the front surface 20*b* of the movable scroll 20. Therefore, the position of the movable scroll 20 relative to the center housing 4 may be determined by the balance between the opposing first and second forces Fa and Fb that are applied against the movable scroll 20.

For example, if the pressure within the motor chamber 45 increases to provide the relationship (Fa<Fb), the movable scroll 20 may be shifted such that the rear surface 20*a* of the movable scroll 20 moves away from the front surface 4*a* of the center housing 4. As a result, resistance against the relative sliding movement between the rear surface 20*a* of the movable scroll 20 and the front surface 4*a* of the center housing 4 may be reduced. Consequently, reductions in the operation efficiency of the compressor 110 can be prevented and the durability of the compressor 110 can be improved.

As the movable scroll 20 thus moves or shifts along its axial direction, the cross section of the clearance CL between the rear surface 20*a* and the front surface 4*a* will increase so as to release or relieve pressure within the motor chamber 45. Therefore, an increased amount of refrigerant may flow from the motor chamber 45 to the suction region 98 via the clearance CL. In this case, the pressure within the motor chamber 45 will decrease and the relationship (Fa>Fb) may result. In this case, the movable scroll 20 may move such that the rear surface 20*a* moves toward the front surface 4*a* of the center housing 4. As a result, the width of the clearance CL may be reduced and the slide resistance between the rear surface 20*a* of the movable scroll 20 and the front surface 4*a* of the center housing 4 may increase. However, the slide resistance between the fixed scroll wall 28 and the movable scroll wall 30 will decrease at this time.

The movable scroll 20 will preferably repeat these reciprocating shifting movements, thereby varying the cross section or width of the clearance CL, until the pressure is adjusted to the intermediate pressure Pm within a predetermined range. Therefore, the movable scroll 20 may serve as a valve mechanism in relation to the clearance CL in order to adjust the pressure within the motor chamber 45. For example, the intermediate pressure Pm may be regulated or adjusted such that the opposing first and second forces Fa and Fb applied to the movable scroll 20 become substantially equal to each other. Also, the flow of refrigerant through the first conduct route 94, the motor chamber 45 and the clearance CL may contribute to cooling the electric motor 49.

The maximum possible size or width of the clearance CL may be suitably determined in response to the configuration (e.g. cross sectional area and the length) of the first conduct route 94, the desired pressure (set value for the intermediate pressure Pm), the pressure receiving area S of the rear surface 20*a* and/or any other relevant parameters. In addition, the configuration of the first conduct route 94 may preferably be determined to ensure that (a) the pressure within the motor chamber 45 may quickly increase after compressor 110 begins operating, (b) the desired amount of refrigerant is transferred to the motor chamber 45 and (c) the necessary compression efficiency of the compressor is attained.

As described above, the second representative scroll compressor enables the adjustment of the opposing forces applied to the movable scroll 20 by using the clearance CL defined between rear surface 20*a* of the movable scroll 20 and the front surface 4*a* of the center housing 4.

The present teachings are not limited to the above representative embodiments and the above representative embodiments may be modified in various ways, such as the examples that are noted below.

(A) For example, as noted above, the first and second representative embodiments respectively utilize the throttle channel 97 and the clearance CL in order to control the flow of refrigerant from the motor chamber 45 to the suction region 98 of the compression mechanism 21. However, these structures may be replaced with a control valve, e.g. an electromagnetic valve, that is disposed within an appropriate route connecting the motor chamber 45 and the suction region 98 of the compression mechanism 21. In addition, any two or three of the throttle path 97, the clearance CL and the control valve may be combined to provide a control device for adjusting the balance of the opposing forces Fa and Fb.

(B) Although the refrigerant within the motor chamber 45 is respectively communicated to the suction region 98 of the compression mechanism 21 via the throttle channel 97 and the clearance CL in the above representative embodiments, the refrigerant may instead be communicated directly into the compression chamber 32.

(C) Although the rear surface 20*a* of the movable scroll 20 opposes to the motor chamber 45 in the above first and second representative embodiments, the rear surface 20*a* of the movable scroll 20 may communicate with the motor chamber 45 via a separate communication channel. In the alternative, a seal member may be interposed between the rear surface 20*a* of the movable scroll 20 and the motor chamber 45. In this case, the pressure applied to the rear surface 20*a* may be decreased in comparison with the pressure within the motor chamber 45 by a value corresponding to the loss of pressure due to the seal member.

(D) Further, the first conduct route 94 may be configured to control or regulate the flow of refrigerant into the motor chamber 45. For example, the first conduct route 94 itself may have a small cross section or a throttle member (e.g., a valve) may be disposed within the first conduct route 94. Therefore, the flow rate of the refrigerant that flows into the motor chamber 45 may be controlled so as to prevent excessive increases in pressure, thereby minimizing the reduction of compressor efficiency. In other words, it is sufficient that at least one of the first conduct route 94 and the throttle channel 97 serves to control the flow of refrigerant.

(E) Furthermore, although the first and second representative compressors include the inverter 60 that controls the electric motor 49, the inverter 60 may be omitted.

What is claimed is:

1. A scroll compressor, comprising:

a fixed scroll, a movable scroll disposed opposite to the fixed scroll, the movable scroll including a front portion and a rear portion, the front portion substantially slidably contacting the fixed scroll and the rear portion substantially slidably contacting a portion of a compressor housing, at least one compression chamber defined between the fixed scroll and the movable scroll, a motor driving the movable scroll, whereby the movable scroll revolves relative to the fixed scroll, so that a refrigerant is drawn from a suction-side region into the compression chamber is compressed within the compression chamber and the compressed refrigerant is discharged to a discharge-side region as the movable scroll revolves, a motor chamber defined within the compressor housing and accommodating the motor;

a first conduct route communicating discharged refrigerant from the discharge-side region to the motor chamber, and a second conduct route connecting the motor chamber to a suction-side region of the fixed and movable scrolls, wherein the pressure within the suction-side region and/or the compression chamber applies a first force against the front portion of the movable scroll and the pressure within the motor chamber applies a second force against the rear portion of the movable scroll and the second conduct route is arranged and constructed to substantially balance the opposing first and second forces, and wherein the second conduct route comprises a throttle channel that is defined between the suction-side region and the motor chamber.

2. A scroll compressor as defined in claim 1, wherein the second conduct route is arranged and constructed so that Ps <Pm <Pd, wherein Pm is the pressure within the motor chamber, Ps is the pressure within the suction-side region, and Pd is the pressure within the discharge-side region.

3. A scroll compressor as in claim 1, wherein the throttle channel has a cross sectional area that is smaller than a cross sectional area of the first conduct route.

4. A scroll compressor as in claim 1, wherein the second conduct route comprises a clearance that is defined between the rear portion of the movable scroll and the portion of the compressor housing that is opposite to the rear surface of the movable scroll.

5. A method for balancing opposing forces applied to a movable scroll of a scroll compressor, which compressor includes a fixed scroll disposed opposite to the movable scroll, and at least one compression chamber defined between the fixed scroll and the movable scroll, comprising:

applying a first force against a front portion of the movable scroll, applying a second force against a rear portion of the movable scroll, wherein the direction of the first force is opposite to the direction of the second force, and adjusting the opposing first and second forces so that the movable scroll revolves with respect to the fixed scroll with a minimal resistance applied against the sliding movement of the movable scroll relative to the fixed scroll and/or a portion of the compressor housing opposite to the movable scroll, wherein the step of applying the second force includes communicating compressed refrigerant from a discharge-side region to a motor chamber that accommodates a motor for driving the movable scroll, wherein the second force is generated by the pressure within the motor chamber, and wherein the step of adjusting the opposing first and second forces includes reducing the pressure within the motor chamber.

6. A method as in claim 5, wherein the step of adjusting the opposing first and second forces further includes decreasing the flow of discharged refrigerant from the discharge side region to the motor chamber.

7. A method as in claim 5, wherein the step of adjusting the opposing first and second forces further includes reducing the pressure within the compression chamber.

8. A scroll compressor comprising:

a fixed scroll having a discharge port for discharging compressed refrigerant to a discharge-side region, a movable scroll disposed to oppose to the fixed scroll, wherein at least one compression chamber is defined between the movable scroll and the fixed scroll;

an electric motor driving the movable scroll, whereby the movable scroll revolves relative to the fixed scroll in order to compress a refrigerant disposed within the at least one compression chamber, a motor chamber accommodating the electric motor and communicating with a rear surface of the movable scroll, wherein the motor chamber also communicates with the discharge-side region via a first conduct route, and a second conduct route communicating refrigerant between the motor chamber and a suction-side region of the fixed and movable scrolls, wherein the second conduct route comprises a clearance defined between the motor chamber and the suction-side region.

9. A scroll compressor as in claim 8, wherein the second conduct route comprises a throttle channel that connects the motor chamber to the suction-side region, the throttle channel being configured to restrict the flow of refrigerant from the motor chamber to the suction-side region.

10. A scroll compressor as in claim 8, wherein the first conduct route restricts the flow of refrigerant toward the motor chamber.

11. A method of compressing a refrigerant in a scroll compressor, the scroll compressor comprising a fixed scroll, a movable scroll disposed so as to oppose to the fixed scroll, a compression chamber defined between the movable scroll and the fixed scroll, an electric motor driving the movable scroll and a motor chamber accommodating the electric motor and communicating with a rear surface of the movable scroll, the method comprising:

revolving the movable scroll relative to the fixed scroll in order to compress a refrigerant disposed within the compression chamber, discharging the compressed refrigerant via the fixed scroll;

communicating the compressed refrigerant into the motor chamber and into a suction-side region to thereby adjust the pressure within the motor chamber to an intermediate pressure between the pressure of the discharged refrigerant and the pressure within the suction-side region, and communicating refrigerant via a clearance defined between the motor chamber and the suction-side region, wherein the clearance restricts the flow of refrigerant from the motor chamber into the suction-side region.

12. A method as in claim 11, further including communicating refrigerant from the motor chamber to a suction-side region via a throttle channel.

13. A scroll compressor comprising:

a fixed scroll disposed opposite to a movable scroll, wherein at least one compression chamber is defined between the fixed scroll and the movable scroll, means for applying a first force against a front portion of the movable scroll, means for applying a second force against a rear portion of the movable scroll, wherein the direction of the first force is opposite to the direction of the second force, and means for adjusting the opposing first and second forces so that movable scroll revolves with respect to the fixed scroll with a minimal resistance applied against the sliding movement of the movable scroll relative to the fixed scroll and/or a portion of the compressor housing opposite to the movable scroll, wherein means for applying the second force includes means for communicating compressed refrigerant from a discharge-side region to a motor chamber that accommodates a motor for driving the movable scroll, wherein the second force is generated by the pressure within the motor chamber, and wherein the means for adjusting the opposing first and second forces further includes means for reducing the pressure within the compression chamber.

14. A scroll compressor as in claim 13, wherein the means for adjusting the opposing first and second forces includes means for reducing the pressure within the motor chamber.

15. A scroll compressor as claim 13, wherein the means for adjusting the opposing first and second forces further includes means for decreasing the flow of discharged refrigerant from the discharge side region to the motor chamber.

16. A scroll compressor, comprising:

a fixed scroll, a movable scroll disposed opposite to the fixed scroll, the movable scroll including a front portion and a rear portion, the front portion substantially slidably contacting the fixed scroll and the rear portion substantially slidably contacting a portion of a compressor housing, at least one compression chamber defined between the fixed scroll and the movable scroll, a motor driving the movable scroll, whereby the movable scroll revolves relative to the fixed scroll, so that a refrigerant is drawn from a suction-side region into the compression chamber is compressed within the compression chamber and the compressed refrigerant is discharged to a discharge-side region as the movable scroll revolves, a motor chamber defined within the compressor housing and accommodating the motor;

a first conduct route communicating discharged refrigerant from the discharge-side region to the motor chamber, and a second conduct route connecting the motor chamber to a suction-side region of the fixed and movable scrolls, wherein the pressure within the suction-side region and/or the compression chamber applies a first force against the front portion of the movable scroll and the pressure within the motor chamber applies a second force against the rear portion of the movable scroll and the second conduct route is arranged and constructed to substantially balance the opposing first and second forces, and wherein the second conduct route comprises a clearance that is defined between the rear portion of the movable scroll and the portion of the compressor housing that is opposite to the rear surface of the movable scroll.

17. A scroll compressor comprising:

a fixed scroll having a discharge port for discharging compressed refrigerant to a discharge-side region, a movable scroll disposed to oppose to the fixed scroll, wherein at least one compression chamber is defined between the movable scroll and the fixed scroll;

an electric motor driving the movable scroll, whereby the movable scroll revolves relative to the fixed scroll in order to compress a refrigerant disposed within the at least one compression chamber, a motor chamber accommodating the electric motor and communicating with a rear surface of the movable scroll, wherein the motor chamber also communicates with the discharge-side region via a first conduct route that restricts the flow of refrigerant toward the motor chamber, and a second conduct route communicating refrigerant between the motor chamber and a suction-side region of the fixed and movable scrolls.

* * * * *